US005093602A

United States Patent [19]

Kelly

[11] Patent Number: 5,093,602

[45] Date of Patent: Mar. 3, 1992

[54] METHODS AND APPARATUS FOR DISPERSING A FLUENT MATERIAL UTILIZING AN ELECTRON BEAM

[75] Inventor: Arnold J. Kelly, Princeton Junction, N.J.

[73] Assignee: Charged Injection Corporation, Monmouth Junction, N.J.

[21] Appl. No.: 438,696

[22] Filed: Nov. 17, 1989

[51] Int. Cl.[5] ..... H01J 33/04; H01J 17/22; H05F 3/00; B05B 5/025

[52] U.S. Cl. ..... 313/231.01; 313/420; 361/227; 239/463; 239/3

[58] Field of Search ..... 313/231.01, 231.31, 313/231.51, 420; 361/226, 227; 239/463, 487, 489, 590.5, 3

[56] References Cited

U.S. PATENT DOCUMENTS

| | | | |
|---|---|---|---|
| 2,737,593 | 3/1956 | Robinson . | |
| 3,122,633 | 2/1964 | Steigerwald . | |
| 3,472,382 | 10/1969 | Soriente et al. | 239/463 |
| 3,676,673 | 7/1972 | Coleman . | |
| 4,061,944 | 12/1977 | Gay | 313/420 |
| 4,112,307 | 9/1978 | Foll et al. . | |
| 4,218,410 | 8/1980 | Stephan et al. . | |
| 4,255,777 | 3/1981 | Kelly . | |
| 4,295,808 | 10/1981 | Stephan et al. . | |
| 4,324,361 | 4/1982 | Moos et al. | 239/3 |
| 4,455,470 | 6/1984 | Klein et al. | 313/231.31 |
| 4,469,932 | 9/1984 | Spiegelberg et al. | 313/231.31 |
| 4,506,136 | 3/1985 | Smyth et al. | 313/231.51 |
| 4,618,432 | 10/1986 | Mintz et al. . | |
| 4,631,444 | 12/1986 | Cheever . | |
| 4,663,532 | 5/1987 | Roche . | |
| 4,706,890 | 11/1987 | Talacko | 361/227 |
| 4,759,500 | 7/1988 | Hoffman et al. | 239/3 |
| 4,802,625 | 2/1989 | Buschor | 239/3 |
| 4,911,947 | 3/1990 | Melcher | 427/26 |

OTHER PUBLICATIONS

Mizuno et al., *Use of an Electron Beam for Particle Charging*, IEEE Transactions on Industry Applications, vol. 26, No. 1, Jan.-Feb. 1990 at 29.

Mahoney et al., *Fine Powder Production Using Electrohydrodynamic Atomization* conference paper, IEEE-IAS 1984 annual meeting.

*Primary Examiner*—Donald J. Yusko
*Assistant Examiner*—Brian Zimmerman
*Attorney, Agent, or Firm*—Lerner, David, Littenberg, Krumholz & Mentlik

[57] ABSTRACT

Apparatus for dispersing a fluent material such as a liquid includes a device for discharging a stream of the fluent material and a device for providing energetic electrons such that the electrons impinge on the fluent material to provide a net negative charge on the fluent material in the discharged stream. The fluent material discharged is dispersed at least partially under the influence of the net negative charge so imparted. The electron-supply device includes a chamber separated from the fluid passageway by an electron-permeable membrane, and may also include an electron gun for generating a beam of energetic electrons such that the electron beam passes through the window and impinges on the fluent material. The electrons may impinge on the fluent material as the fluent material is discharged from the device so that the fluid flow carries the charged portions of the fluent material away from the device. The apparatus may be used to atomize liquids even where the liquids are electrically conductive.

23 Claims, 3 Drawing Sheets

METHODS AND APPARATUS FOR DISPERSING A FLUENT MATERIAL UTILIZING AN ELECTRON BEAM

The present invention relates to methods and apparatus for dispersing a fluent material, such as a liquid.

Numerous technical and industrial processes require dispersion of a fluent material. One such dispersion process is atomization of a liquid into droplets. Atomization is employed in industrial processes such as combustion, chemical treatment of liquids, spray coating and spray painting. It is ordinarily desirable in dispersion processes such as atomization to produce a fine, uniform dispersion of the fluent material. Thus, in atomization it is desirable to convert the liquid into fine droplets, most desirably droplets of substantially uniform size.

Considerable effort has been devoted heretofore to development of methods and apparatus for dispersing fluent materials. For example, mechanical atomizers which operate by forcing a liquid to be atomized under high pressure through a fine orifice. Such mechanical atomizers are used in oil burners and as fuel injectors in combustion engines. Other mechanical dispersion devices mix the fluent material to be atomized with a gas flowing at high velocity, so that the fluent material is dispersed by the kinetic effect of the high velocity gas.

A technique known as electrostatic atomization has also been employed. In electrostatic atomization, an electrical charge is applied to the fluent material, typically as the fluent material is discharged from an orifice Because the various portions of the fluent material bear charges of the same polarity, various portions of the fluent material tend to repel one another. This tends to disperse the fluent material. In a rudimentary form of electrostatic atomization, the fluid is discharged from a nozzle towards a counterelectrode. The nozzle is maintained at a substantial electrical potential relative to the counterelectrode. This type of electrostatic atomization is used, for example, in electrostatic spray painting systems. Electrostatic atomization systems of this nature, however, can apply only a small net charge to the fluid to be atomized and hence the electrostatic atomization effect is minimal.

U.S. Pat. No. 4,255,777 discloses a different electrostatic atomization system. As taught in the '777 patent, the fluid may be passed between a pair of opposed electrodes before discharge through the orifice. These opposed electrodes are maintained under differing electrical potentials, so that charges leave one of the electrodes and travel towards the opposite electrode through the fluid. However, the moving fluid tends to carry the charges downstream, towards the discharge orifice. Generally, the velocity of the fluid is great enough that most all of the charges pass downstream through the orifice and do not reach the opposite electrode. Thus, a net charge is injected into the fluid by the action of the opposed electrodes. Systems according to the '777 patent can apply substantial net charge to the fluid and hence can provide superior atomization.

Systems according to the '777 patent, however, can only be applied where the fluid has relatively low electrical conductivity, typically below about 1 microSiemens per meter. Where the electrical conductivity of the fluid is substantially greater than 1 microSiemens per meter, it is difficult to maintain a substantial potential difference between the electrodes. Although numerous organic liquids can be successfully atomized by the methods and apparatus of the '777 patent, many other industrial significant materials are too conductive and hence cannot be atomized or dispersed by the methods and apparatus of the '777 patent. For example, typical aqueous solutions of inorganic materials are highly conductive and hence not readily susceptible to electrostatic atomization according to the '777 patent. These conductive solutions include industrially important material such as water based paints and coatings, comestible materials such as beverage extracts and agricultural materials such as aqueous fertilizer solutions, herbicide solutions and the like.

U.S. Pat. No. 4,618,432 briefly mentions the possibility of using an electron beam to apply a net charge to a liquid (Column 6, line 19), but offers no teaching of how to do so. U.S. Pat. Nos. 4,218,410 and 4,295,808 and Mahoney et al., *Fine Powder Production Using Electrohydrodynamic Atomization*, conference paper, metal powder by processes wherein an electron beam impinges on a mass of metal under high vacuum conditions. U.S. Pat. Nos. 2,737,593 and 3,122,633 refer to treatment of liquids by electron beams for purposes other than atomization. U.S. Pat. Nos. 3,676,673; 4,112,307; 4,663,532 and 4,631,444 are directed to various structures employing an electron-permeable membrane, also referred to as an "electron window".

Despite these efforts in the prior art, there has been a substantial, unmet need heretofore for improved methods and apparatus of dispersion.

SUMMARY OF THE INVENTION

The present invention addresses these needs.

One aspect of the present invention provides apparatus for dispersing a fluent material. The apparatus according to this aspect of the invention includes an electron-permeable membrane having a first side and a second side, and fluent material discharge means for passing fluent material to be dispersed past the first side of the electron-permeable membrane and discharging the fluent material. The apparatus further includes electron supply means for providing free electrons at the second side of the membrane so that the electrons pass through the membrane and enter the fluent material to provide a net negative charge on the fluent material discharged by the fluent material discharge means. In an operation, the discharged fluent material is dispersed at least partially under the influence of the net negative charge imparted by the electrons entering through the membrane. The electron supply means may include a chamber having an interior space on the first side of the membrane, means for maintaining the interior space substantially under a vacuum and means for accelerating electrons to form an electron beam within the interior space and means for directing electrons in the beam through the electron-permeable membrane to impinge upon the fluent material. The fluent material discharge means may include a body defining a passageway having a downstream end and a discharge orifice at the downstream end of the passageway, and means for advancing the fluent material through the passageway to the discharge orifice so that the fluent material is discharged from the discharge orifice. The electron-permeable membrane preferably is disposed adjacent the discharge orifice so that the electrons passing through the membrane will impinge on the fluent concomitantly with passage of the fluent material through the discharge orifice. The means for passing the fluent material may include means for projecting the fluent material in a stream surrounding a discharge axis and moving generally parallel to the discharge axis and the electron supply means may include means for directing electrons into the stream adjacent to the discharge axis. For example, the electron-permeable membrane may be disposed at an injection location upstream of the discharge orifice and the electron supply means may include electron beam means for directing an electron beam through the membrane substantially in the axial direction from the injection location towards the discharge orifice. The means for passing fluent material may include means for directing fluent material into rotational flow about the discharge axis so as to form a vortex adjacent the discharge axis, and the electron beam means may include means for directing the electron beam into the vortex. Alternatively, the electron-permeable membrane may encircle the discharge axis and may extend downstream of the discharge orifice.

Use of the electron-permeable membrane permits operation of electron supply apparatus such as the electron beam generating apparatus under high vacuum conditions, even though the fluent material is at atmospheric or superatmospheric pressures. This allows use of electron supply apparatus such as electron beam generating equipment and plasma generating equipment which operate most efficiently under low subatmospheric pressures. Moreover, introduction of electrons through the electron-permeable membrane avoids the need to maintain a potential difference across the fluent material and thus facilitates introduction of a net charge into the fluent material even where the fluent material is electrically conductive.

Because the electrons are introduced into the fluent material as the fluent material passes downstream through the discharge orifice, the downstream motion of the material tends to carry the electrically charged portions of the fluent material away from the apparatus before the charge on these portions of the fluent material can dissipate by conduction through the fluent material to the apparatus.

A further aspect of the present invention provides methods of dispersing a fluent material. In methods according to this aspect of the present invention, the fluent material to be dispersed may be moved past a first side of an electron-permeable membrane and discharged, whereas electrons may be supplied on the second, opposite side of the membrane so that the electrons pass through the membrane and enter the fluent material so as to provide a net charge on the discharge fluent material. The fluent material may be a liquid and the liquid may be atomized at least partially under the influence of the net negative charge imparted by the electrons. The fluent material may be either electrically conductive or nonconductive. As discussed above in connection with the apparatus, the electrons may be introduced into the fluent material as the fluent material exits from a discharge orifice.

Other objects, features and advantages of the present invention will be more readily apparent from the detailed description of the preferred embodiments set forth below taken in conjunction with the accompanying drawings.

DETAILED DESCRIPTION OF THE PREFERRED EMBODIMENTS

Figures 1, 2:
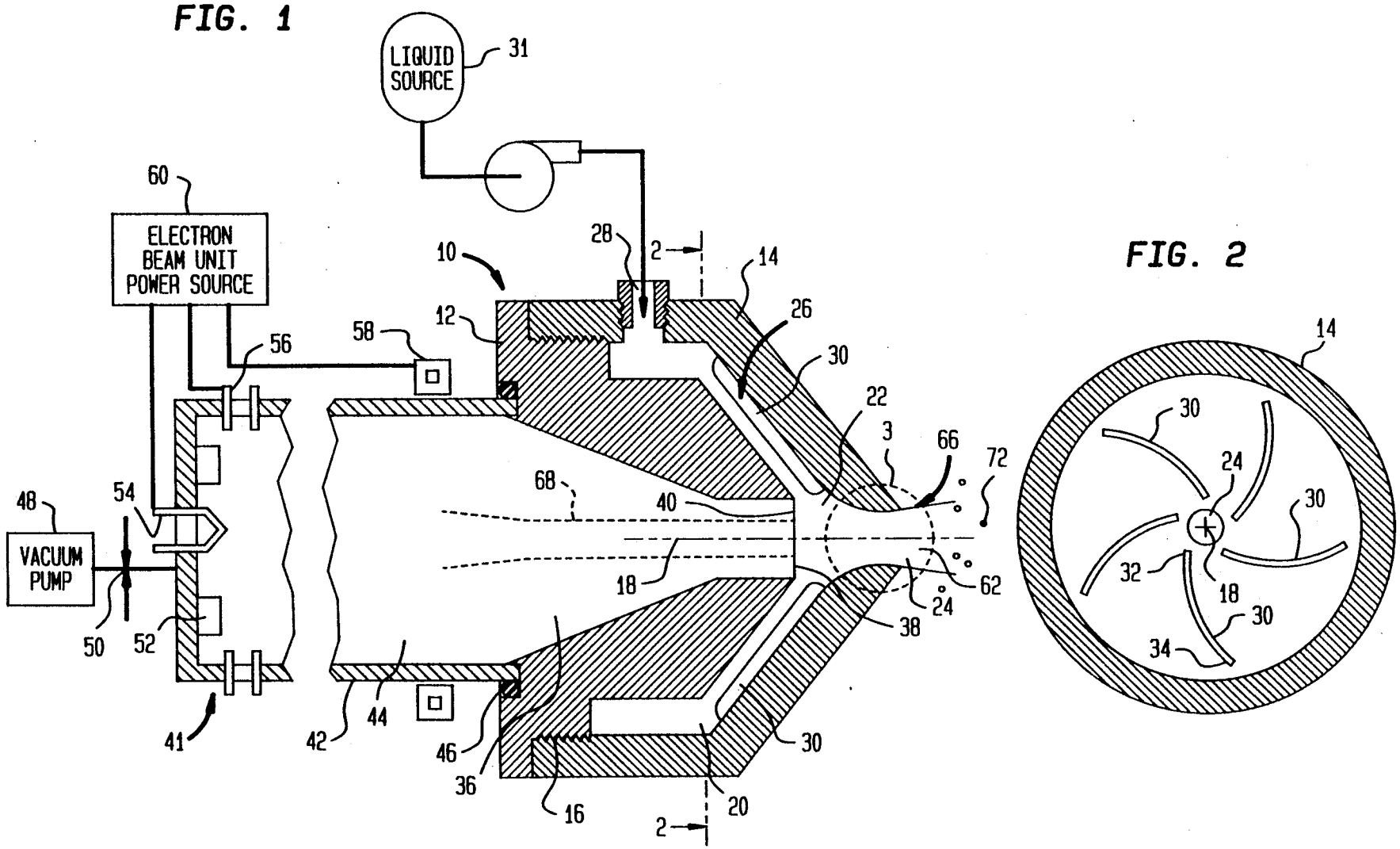
FIG. 1 is a schematic sectional view of apparatus in accordance with one embodiment of the present invention.
FIG. 2 is a sectional view taken along lines 2—2 in FIG. 1, with portions of the apparatus removed for clarity of illustration.

Apparatus in accordance with one embodiment of the present invention includes a body 10 incorporating a central portion 12 and a cover portion 14 attached to the body portion by threads 16. The body portion and cover portion are substantially symmetrical about an axis 18. The body portion and cover portion cooperatively define a cylindrical space 20 and a general conical space 22 leading to a cylindrical discharge orifice 24. Spaces 20 and 22 and discharge orifice 24 are substantially concentric with one another and are centered on axis 18. Spaces 20 and 22 and discharge orifice 24 cooperatively define a continuous passageway 26, the discharge opening 24 being disposed at a downstream end of the passageway. An inlet opening 28 is provided at the upstream end of the passageway, and communicates with cylindrical space 20. A set of vanes 30 project into the conical space 22 and hence into passageway 26 from cover element 14. As best seen in FIG. 2, vanes 30 are disposed at locations spaced apart circumferentially about axis 18. The vanes 30 extend radially with respect to axis 18 and are also curved in a uniform circumferential direction. Thus, as seen in FIG. 2, the radially inward end 32 of each vane is disposed slightly clockwise of the radially outward end 34 of the same vane, but the vane curves in the anticlockwise circumferential direction with respect to axis 18. A pump 29 is connected to a tank or other source 31 of a liquid to be atomized, and to the inlet opening 28 such that the pump 29 can force a liquid from source 31 into the inlet opening 28.

The central portion 12 of body 10 has a bore 36 coaxial with central axis 18 and extending through the central portion to a circular beam inlet opening 38 on axis 18. Beam inlet opening 38 is covered by an electron-permeable membrane 40, so that the membrane 40 separates the space within bore 36 from passageway 26, and so that the membrane forms a wall of the passageway. Membrane 40 is bonded to the central portion 12 of the body around the entire periphery of beam inlet opening 40, so that the membrane and body cooperatively provide air, gas and liquid impermeable barrier. A first side of membrane 40 faces into the passageway, and a second side of membrane 40 faces away from the passageway, into bore 36. Membrane 40 extends substantially perpendicularly to axis 18 and the first side of membrane 40 faces downstream towards discharge orifice 24. Membrane 40 may be formed from boron nitride, beryllium or other known, electron-permeable materials. Most desirably, the membrane 40 has the minimum thickness required to withstand the pressures encountered in service. To permit use of the thinnest possible membranes, it is desirable to minimize the dimensions of the membrane and hence to minimize the dimensions of opening 38. Where membrane 40 is formed from boron nitride, its thickness may be on the order of about 2 micrometers to about 10 micrometers, and most typically about 3 micrometers. Preferably, the diameter of beam inlet opening 38 is about 2 mm to about 10 mm, and most typically about 6 mm. Where the opening 38 is not circular, the smallest dimension of the beam inlet opening may be about 2 mm to about 10 mm, and desirably about 6 mm. These preferred ranges apply with respect to unreinforced boron nitride membranes. Membrane 40 may be reinforced by a grid or mesh of reinforcing elements (not shown) covering one or both surfaces of the membrane In this case, the beam inlet opening may have greater dimensions, or the membrane 40 may be thinner than specified above.

The apparatus further includes an electron gun assembly 41 having an enclosed electron accelerating tube 42, of which only a portion is shown in FIG. 1. Accelerating tube 42 is connected to the central portion 12 of body 10 such that the interior space 44 within accelerating tube 42 is in communication with the interior bore 36 of body 12. A high vacuum seal 46 is provided at the juncture of tube 42 and body 12, such that the interior space 44 and bore 36 are effectively isolated from the surrounding atmosphere. When tube 44 is first assembled with body 12, the interior space 44 and bore 36 are evacuated by a conventional vacuum pump 48. After evacuation, the connection between the pump 48 and the interior space may be broken, as by a valve 50 and the pump may be removed. A chemical substance 52 adapted to react with and consume any atmospheric gases present within space 44 is also provided inside of space 44. Such chemical substances are commonly referred to as "getters" and are well known in the electron tube art. Where the seal 46 between the tube and body is particularly effective, the getter may be omitted. Alternatively, where there is appreciable leakage into the interior space 44, the vacuum pump 48 may remain connected to the space.

Desirably, the interior space within the acceleration tube and bore are maintained substantially at a vacuum, i.e., at an internal absolute pressure less than about $10^{-6}$ Torr and desirably less than about $10^{-7}$ Torr. Electron gun assembly 41 is equipped with a conventional cathode 54 and conventional electron accelerating devices such as conductive rings 56 spaced along the length of tube 42. Further, the electron gun assembly includes an electron beam focusing device such as the coil 58 schematically depicted in FIG. 1. These elements are connected to a conventional electrical power source 60 of the type commonly employed for electron beam operations. Power source 60 is arranged to apply a substantial negative electrical potential to cathode 54, and to apply appropriate electrical potentials to rings 56 so that electrons will be discharged from cathode 54 and accelerated away from the cathode by electrostatic potentials applied through rings 56. The power source is arranged to energize coil 58 to provide a focusing magnetic field so as to focus these accelerated electrons into a relatively narrow beam directed substantially along axis 18.

Figure 3:
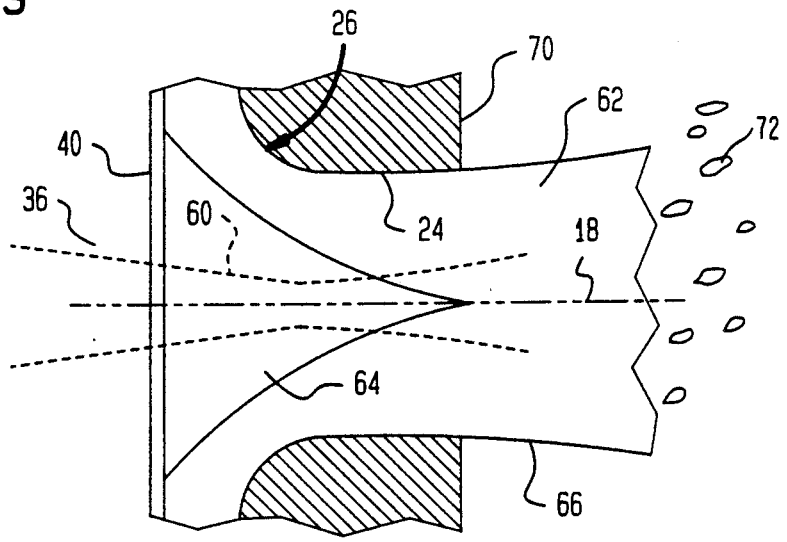
FIG. 3 is a fragmentary, idealized sectional view depicting a portion of the apparatus of FIG. 1 on an enlarged scale.

A method according to one embodiment of the invention utilizes the apparatus discussed above with reference to FIGS. 1-3. Pump 29 is actuated to draw a liquid from liquid source 31 and force the liquid downstream through passageway 26, and hence through discharge orifice 24. The liquid may be an electrically conductive liquid such as an aqueous solution of an inorganic salt, or else may be a substantially non conductive liquid such as a liquid hydrocarbon. As used in this disclosure with reference to a liquid, the term "conductive" means having an electrical resistivity of less than about $10^6$ ohm-meter. Many conductive liquids have still lower resistivities, typically as low as about 1 ohm-meter or less. The term "non-conductive," as used with reference to a liquid, means having an electrical resistivity greater than about $10^6$ ohm-meter, and typically greater than about $10^8$ ohm-meter.

The liquid passing downstream through passageway 26 encounters vanes 30 as the liquid traverses the conical portion 22 of the passageway and approaches the discharge orifice 24. Vanes 30 impart a swirling, rotational motion about axis 18 to the liquid. As the swirling liquid 62 enters discharge orifice 24, it forms a whirling vortex about axis 18, and hence forms a hollow vortex space or gap 64 (FIG. 3) immediately around the axis 18. The liquid passing through the discharge orifice is projected downstream from the orifice as a whirling stream 66 moving generally parallel to axis 18.

While the pump 29 is in operation, electron gun assembly 41 and power source 60 are actuated to provide a beam 68 of electrons. The beam 68 is directed by focusing coil 58 through electron-permeable membrane 40 and hence into passageway 26. The beam enters the passageway through the membrane 40 at the beam inlet opening 38. The electrons in beam 68 pass downstream from the beam inlet opening generally parallel to axis 18, towards discharge orifice 24. As best appreciated with reference to FIG. 3, the electrons in beam 68 impinge upon the liquid 62 as the liquid passes through orifice 24. The gap or space 64 created by the swirling vortex allows at least a portion of the beam 68 to penetrate downstream into orifice 24 and, depending upon the extent of the vortex, beyond the downstream edge 70 of the orifice. As the space 64 within the vortex is filled with vapors of the liquid and/or atmospheric gases, there may be some interaction between the beam and the gases in the hollow space. However, this interaction is relatively minor, so that the major portion of the electrons in beam 68 impinge upon the liquid 62. As the electron beam 68 passes through membrane 40 and into vortex space 64 and the stream 66, the electron beam encounters gasses within the vortex space and creates negatively charged ions, i.e., gas atoms and/or molecules incorporating one or more additional electrons. The beam spreads away from the axis 18 under the influence of mutual repulsion between the negatively charged electrons and ions. Thus, the beam spreads radially outwardly, away from axis 18 into the body of the stream 66. As the electrons and ions impinge upon the liquid, the liquid assumes a net negative charge. Although the present invention is not limited by any theory of operation, it is believed that some or all of the free electrons in the original beam passing through the membrane may become attached to atoms or molecules and form negative ions before the electron impinges on the fluid stream. However, regardless of whether the electrons are free or attached as ions, the result is the same, in that the electrons pass into the fluid stream. Each negative ion which passes into the fluid stream carries one or more extra electrons into the fluid with it. As the negatively charged portions of the liquid tend to repel one another, the liquid stream 66 fragments into droplets 72, thus atomizing the liquid. The atomization process may be assisted by mechanical action of the liquid passing through the orifice. Thus, the stream 62 will tend to fragment to some extent even in the absence of the electron beam. However, the atomization process is materially enhanced by the negative charges applied by the electron beam.

Where the liquid 62 is conductive, the charge applied to the liquid by the electron beam may be dissipated to some extent by conduction. Thus, the charge applied by the electron beam tends to flow through the liquid to the nearest available ground. Preferably, the nozzle body 10 is formed from an electrically insulating material or else is substantially electrically isolated from ground. Liquid source 31 and pump 29 may themselves be isolated from an electrical ground, so that as the system operates, the liquid source, the pump, the conduits connecting them to the inlet opening 28 and the liquid within them assume a net negative charge. Alternatively, the conduits connecting the pump 29 to the inlet opening may be formed from an insulating material, and may be relatively small across section and relatively substantial length, so that the only electrical pathway from the nozzle to the pump is a high impedance pathway through the liquid column in the conduits. This arrangement minimizes current flow and hence charge dissipation, even where the pump 29 is grounded.

Even where there is an available electrical path from the liquid to ground, as where the nozzle body itself is conductive and grounded, or where there is a high conductivity pathway through the liquid conduits, not all of the charge applied by the electron beam will be dissipated. The velocity of charges in a typical conductive liquid is finite, and is considerably less than a velocity of light. In a typical conductive liquid charges are transferred by diffusion of ions through the liquid under the influence of the voltage gradient or prevailing electric field. Such diffusion proceeds at a rapid but finite speed. In the preferred embodiments of the present invention, the charges are injected into the liquid just as the liquid passes through the discharge orifice. At this point, the liquid is passing downstream, away from body 10 at a substantial velocity. If the downstream velocity of the liquid exceeds the charge velocity in the liquid, the charges will move downstream with the exiting liquid stream, away from the body and away from the discharge orifice 24. Even where body 10 is grounded and electrically conductive, some or all of the charge applied by the electron beam will remain in the exiting liquid.

The charge remaining in the exiting liquid desirably amounts to at least about $3\times10^{-3}$ coulombs per on the order of at least about $4\times10^{-3}$ coulombs per liter or at least about $5\times10^{-3}$ coulombs per liter are more preferred. Thus, for each ml/sec liquid flow through the system, the current of electrons in electron beam 68 amounts to about $3\times10^{-6}$ amperes or more, and preferably about $4\times10^{-6}$ and most desirably at least about $5\times10^{-6}$ amperes. Still higher levels of beam current are even more desirable. Desirably, the beam voltage (the kinetic energy of the electrons in beam 68) amounts to about 15 kV. Higher energy levels are useful and preferred. However, generation of electron beams at energy levels above about 30 kV generally requires more complex equipment incorporating special, expensive high voltage insulation in the power supply. Accordingly, electron beam of voltages within a range of about 15 kV to about 30 kV are most preferred.

The apparatus and methods discussed above may be employed using a wide variety of fluid materials. In particular, both conductive and non-conductive liquids may be atomized. Substantially the same apparatus and methods can be used to treat fluent materials incorporating a solid phase, such as a fluent powder or a suspension of a solid in a liquid or gas. In this case, the individual particles of the solid may be charged by exposure to the electron beam, and hence may be dispersed by processes including a mutual repulsion of the charged particles. Typically, the shape and size of the passageway 26 in body 10 would be selected to accommodate a flow of the solid particle of material without binding or jamming, and the solid particles of material would be fed by an appropriate feeding device such as a vibratory feeder, ram or the like. Processes according to this aspect of the invention provide a dispersion of the solid particle material in the surrounding atmosphere, rather than atomization of a liquid. As used herein, the term "a dispersion" and the "dispersing" should be understood broadly, as encompassing both dispersion of a solid particle material and atomization of a liquid material.

The liquid droplets or dispersed solids provided at the downstream portion of the fluent material stream may be employed in substantially the same way as liquid droplets created by conventional nozzles. Thus, liquid droplets resulting from the process may be blended with a gas, as in a combustion process or in creation of a fog, mist or vapor. The droplets may also impinge on a solid substrate, such as a workpiece to be coated with the liquid. The substrate (not shown) may be grounded or may be maintained at a positive potential relative to ground so as to attract the negatively charged droplets. Likewise, where fluent solid material is dispersed, the same may be applied to a solid substrate, and the solid substrate may be positively charged to attract the solid particles.

In the apparatus and methods discussed above, the stream of electrically charged fluent material passes downstream from the discharge orifice into the atmosphere. Corona discharge or electrical breakdown of the atmosphere surrounding the stream may cause some dissipation of the electrical charge on the fluent material hence may limit the charge which can be maintained in the stream to produce a dispersion. To suppress such a corona discharge, the stream may be surrounded with a blanket of a dielectric gas. Such blanket need only extend downstream to about the point where the stream becomes substantially dispersed. As disclosed in U.S. Pat. No. 4,605,485, the dielectric gaseous stream may be provided by a separate, annular orifice surrounding the discharge orifice of an electrostatic atomization device. Conversely, as disclosed in a U.S. Pat. No. 4,630,169, the inert gas blanket may be provided by adding a volatile dielectric liquid to the fluent material to be atomized prior to discharge of the fluent material through the discharge orifice, so that the dielectric gas blanket is formed by vapors of the volatile liquid. Either of these approaches may be employed with atomization methods and apparatus according to the present invention.

The measures disclosed in copending, commonly assigned U.S. Pat. No. 4,991,774 and issued Feb. 12, 1991 as U.S. Pat. No. 4,991,774 may also be employed. The disclosure of said U.S. Pat. No. 4,991,774 is hereby incorporated by reference herein. As disclosed in greater detail in said '774 application, the charged fluid stream may be protected from the surrounding atmosphere by a mist, which may be formed from the same or a different liquid as incorporated in the principal stream to be atomized. Even a conductive liquid may form a useful mist for this purpose. Alternatively or additionally, the stream may be surrounded by a vapor formed by heating a portion of the principal liquid to be atomized.

The apparatus according to the present invention typically is operated to discharge the stream of fluent material to be dispersed into a surrounding atmosphere which is at a moderate subatmospheric pressure of about 1 kPa absolute or above, at about normal atmospheric pressure or above (about 100 kPa absolute) pressure or above. The pressure of the fluent material within passageway 26 will depend upon the factors such as the flow rate of the fluent material, its viscosity or resistance to flow and the dimensions of the passageway and discharge orifice 24. Typically, however, the fluent material is under atmospheric or superatmospheric pressures. As discussed above, the electron-permeable membrane 40 effectively isolates the interior space 44 within the electron gun chamber from these high fluid pressures and hence permits acceleration and focusing of the electron beam substantially in a vacuum.

Figure 4:
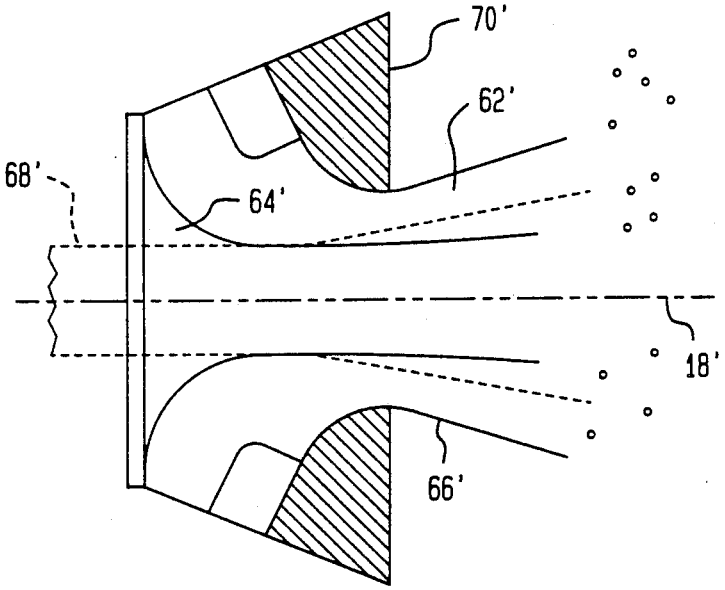
FIGS. 4, 5 and 6 are views similar to FIG. 3 but depicting apparatus according to additional embodiments of apparatus according to the invention.

As illustrated diagrammatically in FIG. 4, the vortex opening 64' within the swirling mass of fluid 62'60 may extend downstream to the point where the fluid stream 66' breaks into droplets. In this case, the electron beam 68' may pass downstream within vortex opening 64'. Nonetheless, the electron beam will impinge upon the fluid in the stream. As the electrons in the beam and ions incorporating such electrons tend to repel one another, the beam spreads radially outwardly, away from axis 18' as it passes downstream, so that the electrons (whether free or ion-attached) in the beam will pass radially outwardly, away from axis 18' and enter the stream of fluent material. The electrons may enter the fluent material over a region of the stream extending from upstream of the downstream edge 70' of the discharge orifice to downstream of such edge. Depending upon the configuration of the stream and of the beam, the electrons may enter the fluent material entirely downstream of the discharge orifice.

Figure 5:
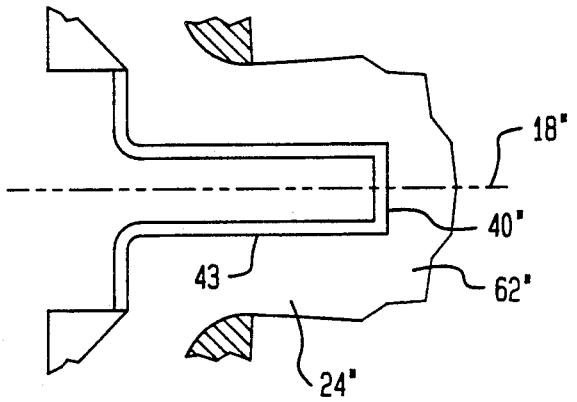

As seen in FIG. 5, the electron-permeable membrane 40'' need not be planar as in the embodiments discussed above but may instead incorporate a cylindrical portion 43 protruding downstream through the discharge orifice 24''. Here again, as the electron beam passes downstream within the protruding cylindrical portion 43, it will spread radially outwardly, away from the central axis 18''. Accordingly, electrons will pass outwardly through this region of the electron-permeable membrane into the fluid 62''.

Figure 6:
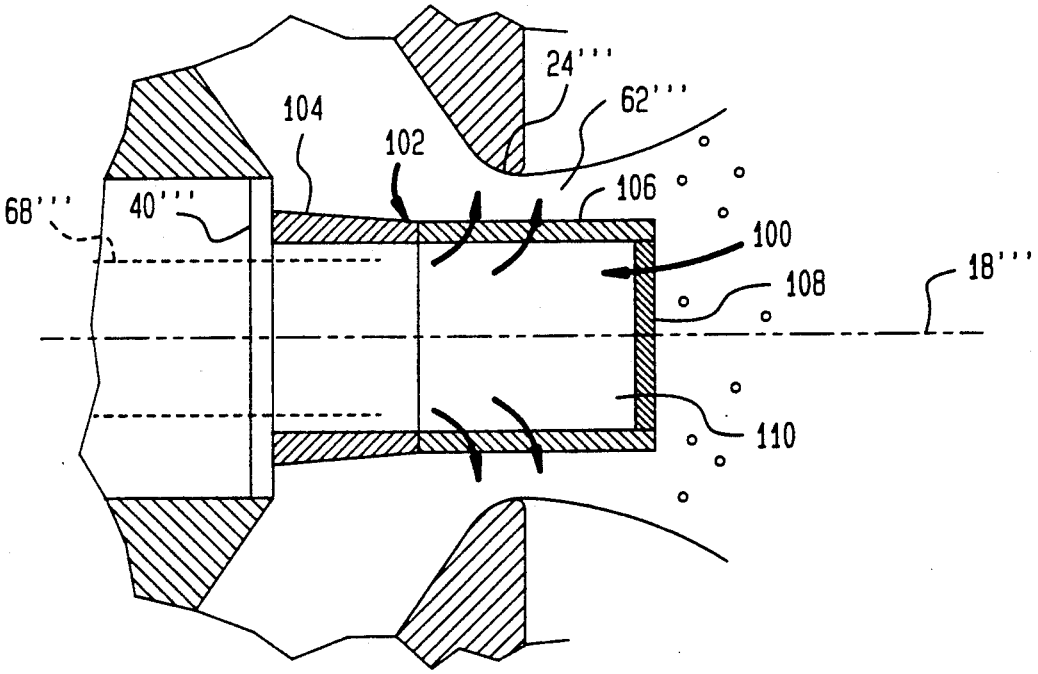

The apparatus illustrated in FIG. 6 has a generally planar electron-permeable membrane 40 similar to the membrane 40 of the apparatus discussed above with reference to FIGS. 1-3. Membrane 40''' is mounted upstream of the discharge orifice 24'''. A secondary ionization chamber 100 overlies the portion of membrane 40''' on the axis 18''' and protrudes axially downstream through the discharge orifice 24'''. Chamber 100 has a cylindrical wall 102 incorporating a non-porous cylindrical section 104 adjacent membrane 40''' and a porous, electron-permeable membrane section 106 remote from membrane 40''' and lying adjacent the downstream end of chamber 100. The downstream end of chamber 100 is closed by an impermeable plug 108, whereas the upstream end of the chamber is closed by membrane 40'''. The interior space 110 within chamber 100 is filled with a readily ionizable gas such as helium, neon, argon, krypton, xenon and combinations therof under subatmospheric pressure. The porosity of the wall or membrane section 106 is selected such that the membrane is substantially impermeable to liquids and to the gas within the interior space 110, but substantially permeable to free electrons having moderate energy levels. Among the materials having this property are sintered glasses having a nominal pore size on the order of about 20 to about 40 Angstroms. Suitable sintered glasses are available from Corning Glass Works of Corning, New York under the designation Expanded Vycor, Code 7930. In other respects, the embodiment illustrated in FIG. 6 is similar to the apparatus discussed above with reference to FIGS. 1-3. In operation, the electron beam 68''' generated by the electron gun assembly (not shown) passes through the electron-permeable membrane 40''' and into the space 110 within secondary ionization chamber 100. As electrons enter the chamber, they ionize the gas within chamber 110, thus converting the gas to a plasma or mixture of gas ions and free electrons. Also, as free electrons in the electron beam enter chamber 110, the plasma acquires a net negative charge. Mutual repulsion of the electrons in the plasma forces free electrons out through the membrane or wall 106. As the fluid 62 passing out through discharge orifice 24''' surrounds membrane or wall 106, electrons passing through the membrane enter the fluid as the fluid passes through the discharge orifice. Because the membrane 106 is located adjacent the downstream edge of the discharge orifice, and because the membrane or wall 106 protrudes beyond the downstream edge of the discharge orifice, electrons are introduced into the fluid in the region of the stream at and downstream of the discharge orifice. As in operation of the embodiments discussed above, the electrons introduced into the fluid impart a net negative charge to the fluid and cause it to disperse into droplets. The upstream, impermeable wall 104 of the secondary chamber prevents escape of free electrons from the space 110 within the secondary chamber to the fluid at substantial distances upstream from the discharge orifice. As discussed above, introduction of the charge into the fluid at the downstream location tends to assure that the charges will be swept downstream with the moving fluid, and hence will remain in the fluid even when the fluid has substantial conductivity.

Numerous variations and combinations of the features discussed above can be utilized without departing from the present invention as defined by the claims. For example, sources of electrons other than an electrostatic accelerating gun can be employed. Also, in embodiments employing a secondary chamber as discussed above with reference to FIG. 6, the porous wall may be so porous that some of the gas within the chamber escapes. In that case, the secondary chamber can be continually refilled with gas. In a variant of this approach, the secondary chamber can be continually refilled with a plasma bearing a net negative potential supplied by an external plasma generator such as a radio frequency plasma generator and charged by contact with electrodes maintained at a high negative potential. In this case, the electron beam and associated beam-generating apparatus may be omitted Also, in apparatus such as that discussed with reference to FIGS. 5 and 6, where the apparatus itself incorporates a solid body defining an internal passageway within the stream, there is no need to provide the vortex discussed above with reference to FIGS. 1-4. Therefore, the fluid pathway need not be equipped with vanes 30 (FIG. 2) or other elements for providing rotational movement of the flowing fluid. As these and other variations and combinations of the features discussed above can be utilized, the foregoing description of the preferred embodiment should be taken by way of illustration rather than by way of limitation of the invention as defined by the claims.

What is claimed is:

1. Apparatus for dispersing a fluent material comprising:

(a) an electron-permeable membrane having a first side and a second side;

(b) fluent material discharge means for passing fluent material to be dispersed past said first side of said electron-permeable membrane and discharging the fluent material; and (c) electron supply means for providing free electrons at said second side of said membrane so that the electrons pass through said membrane and enter the fluent material to provide a net negative charge on the fluent material discharged by said fluent material discharge means and the discharged fluent material is dispersed at least partially under the influence of said net charge, wherein the fluent material discharge means includes a body defining a passageway having a downstream end and a discharge orifice at the downstream end of said passageway, and means for advancing said fluent material through said passageway to said discharge orifice so that said fluent material is discharged from said discharge orifice, said electron-permeable membrane being disposed adjacent said discharge orifice, said electron supply means, electron permeable membrane, passageway and orifice being constructed and arranged so that said electrons will impinge on said fluent material, at or downstream of said orifice concomitantly with passage of said fluent material through said discharge orifice.

2. Apparatus as claimed in claim 1 wherein said electron supply means includes a chamber having an interior space on the first side of said membrane, means for maintaining said interior space substantially under a vacuum and means for accelerating electrons to form an electron beam within said interior space, said electron supply means including means for directing electrons in said beam through said electron-permeable membrane to impinge upon said fluent material.

3. Apparatus as claimed in claim 1 wherein said fluent material discharge means includes means for projecting said fluent material in a stream surrounding a discharge axis and moving generally parallel to said discharge axis, through said discharge orifice and said electron supply means includes means for directing said electrons into said stream adjacent said discharge axis.

4. Apparatus as claimed in claim 3 wherein said electron-permeable membrane is disposed at an injection location upstream of said discharge orifice and said electron supply means includes electron beam means for directing an electron beam through said membrane substantially in the axial direction from said injection location towards said discharge orifice.

5. Apparatus as claimed in claim 4 wherein said electron beam means includes a chamber having an interior space and an exit port at said injection location, said electron-permeable membrane covering said exit port and separating said interior space of said chamber from said passageway, said electron beam means further including means for directing said electron beam within said chamber so that said electron beam passes through said electron-permeable membrane into said passageway and means for maintaining said interior space substantially under a vacuum.

6. Apparatus as claimed in claim 4 wherein said electron-permeable membrane extends substantially transversely to said axis direction.

7. Apparatus as claimed in claim 4 wherein said fluent material discharge means includes means for directing said fluent material into rotational flow about said discharge axis so as to form a vortex adjacent said discharge orifice, said electron beam means including means for directing the electron beam into said vortex.

8. Apparatus as claimed in claim 3 wherein said electron-permeable membrane is disposed adjacent said discharge axis.

9. Apparatus as claimed in claim 8 wherein said electron-permeable membrane encircles said discharge axis.

10. Apparatus as claimed in claim 8 wherein said electron-permeable membrane extends downstream of said discharge orifice.

11. Apparatus as claimed in claim 10 wherein said electron-permeable membrane extends through said discharge orifice.

12. Apparatus as claimed in claim 1 wherein said electron supply means includes means defining a gas space, said second side of said electron-permeable membrane bounding said gas space, an ionizable gas within said gas space and means for ionizing said gas and imparting a negative charge to said ionized gas.

13. Apparatus as claimed in claim 12 wherein said means for ionizing said gas and imparting a negative charge to said gas includes a further electron-permeable membrane bounding said gas space and electron beam means for directing an electron beam into said space and through said further electron-permeable membrane.

14. A method of dispersing a fluent material comprising the steps of:

(a) passing a fluent material to be dispersed past a first side of an electron-permeable membrane and discharging the fluent material;

(b) supplying electrons on a second, opposite side of said membrane so that the electrons pass through the membrane and enter the fluent material so as to provide a net charge on the discharged fluent material, whereby the discharged fluent material is dispersed at least partially under the influence of said net charge.

wherein said fluent material has an electrical resistivity of less than about 1 ohm-meter.

15. A method of dispersing a fluent material comprising the steps of:

(a) passing a fluent material to be dispersed past a first side of an electron-permeable membrane and discharging the fluent material;

(b) supplying electrons on a second, opposite side of said membrane so that the electrons pass through the membrane and enter the fluent material so as to provide a net charge on the discharged fluent material, whereby the discharged fluent material is dispersed at least partially under the influence of said net charge, wherein said step of passing said fluent material includes the step of passing said fluent material through a passageway to a discharge orifice at a downstream end of the passageway and discharging the fluent material in a stream from said discharge orifice, said electron-permeable membrane being disposed adjacent said discharge orifice so that said electrons enter the fluent material at or downstream of said orifice concomitantly with discharge of the fluent material through the discharge orifice.

16. A method as claimed in claim 15 wherein said step of passing said fluent material is performed so that said fluent material is discharged under a pressure of at least about $10^{-2}$ atmospheres, and said step of supplying electrons includes the step of providing a beam of electrons within a chamber under a substantial vacuum of about $10^{-6}$ Torr or less and directing said beam of electrons through said electron-permeable membrane to said fluent material.

17. A method as claimed in claim 5 wherein said fluent material is a liquid and said liquid is atomized at least partially under the influence of said negative charge.

18. A method as claimed in claim 15, wherein said fluent material has an electrical resistivity of less than about 1 ohm-meter.

19. A method as claimed in claim 15 wherein said step of discharging said fluent material through said discharge orifice includes the step of projecting said fluent material generally parallel to a discharge axis, said electron-permeable membrane is disposed upstream of said discharge orifice and said step of supplying electrons includes the step of directing an electron beam substantially parallel to said discharge axis towards said discharge orifice so that said electron beam impinges upon said fluent material concomitantly with passage of said fluent material through said discharge orifice.

20. A method as claimed in claim 19 further comprising the step of inducing rotational flow in said fluent material so as to form a vortex adjacent said discharge orifice, said step of directing an electron beam including the step of directing said electron beam into said vortex.

21. A method as claimed in claim 15 wherein said step of supplying electrons includes the step of supplying a negatively charged plasma on said second side of said electron-permeable membrane.

22. A method as claimed in claim 21 wherein said step of supplying a plasma includes the directing of an electron beam through a further electron-permeable membrane into a gas to form and charge said plasma.

23. A method as claimed in claim 22 wherein said gas is selected from the group consisting of helium, neon, argon, krypton, xenon and combinations thereof.

* * * * *

UNITED STATES PATENT AND TRADEMARK OFFICE

CERTIFICATE OF CORRECTION

PATENT NO. : 5,093,602

DATED : March 3, 1992

INVENTOR(S) : Arnold J. Kelly

It is certified that error appears in the above-identified patent and that said Letters Patent is hereby corrected as shown below:

Column 2, line 19, after "paper" insert --IEEE-IAS 1984 annual meeting, suggest formation of a--

Column 7, line 46, after "per" insert -- liter of fluid discharged and higher levels of charge--

Column 8, line 7 "particle" should read --particles--

Column 8, line 60, "application" should read --patent--

Column 9, line 19, "62'60" should read --62'--

Column 9, line 29, "enter" should read --enters--

Column 9, line 48, "40" should read --40'''--

Column 10, line 20, "62" should read --62'''--

UNITED STATES PATENT AND TRADEMARK OFFICE

CERTIFICATE OF CORRECTION

PATENT NO. : 5,093,602

DATED : March 3, 1992

INVENTOR(S) : Arnold J. Kelly

It is certified that error appears in the above-identified patent and that said Letters Patent is hereby corrected as shown below:

Column 11, line 20, "the" should read --said--

Column 12, line 45, "charge." should read --charge, --.

Column 13, line 12, "5" should --15--.

Signed and Sealed this

Twenty-second Day of June, 1993

*Attest:*

Michael K. Kirk

MICHAEL K. KIRK

*Attesting Officer*

*Acting Commissioner of Patents and Trademarks*